US006062961A

United States Patent [19]

Can et al.

[11] Patent Number: 6,062,961

[45] Date of Patent: May 16, 2000

[54] WAFER POLISHING HEAD DRIVE

[75] Inventors: Linh X. Can, San Jose; Kelvin Lum; Gregory A. Appel, both of San Francisco, all of Calif.

[73] Assignee: Aplex, Inc., Sunnyvale, Calif.

[21] Appl. No.: 08/964,817

[22] Filed: Nov. 5, 1997

[51] Int. Cl.[7] ..... B24B 41/06

[52] U.S. Cl. ..... 451/385; 451/279; 451/285; 451/286; 451/287; 451/288; 451/289; 451/290; 451/307; 451/334; 451/339; 451/387; 451/393; 451/394; 451/398; 451/405

[58] Field of Search ..... 451/279, 285, 451/286, 287, 288, 289, 290, 307, 334, 339, 385, 387, 393, 394, 398, 405

[56] References Cited

U.S. PATENT DOCUMENTS

| | | | |
|---|---|---|---|
| 653,531 | 7/1900 | Richmond et al. | 451/289 X |
| 1,275,447 | 8/1918 | Hodny et al. | 451/289 |
| 1,420,751 | 6/1922 | Ricketts | 451/287 X |
| 2,057,290 | 10/1936 | Bradbury | 451/307 |
| 3,841,028 | 10/1974 | Katzke | 451/339 |
| 3,888,050 | 6/1975 | Elm . | |
| 4,450,652 | 5/1984 | Walsh | 451/7 |
| 4,662,116 | 5/1987 | Erani . | |
| 4,736,475 | 4/1988 | Ekhoff . | |
| 4,974,619 | 12/1990 | Yu . | |
| 5,012,618 | 5/1991 | Price et al. . | |
| 5,016,399 | 5/1991 | Vinson | 451/287 X |
| 5,061,144 | 10/1991 | Akimoto et al. . | |
| 5,241,792 | 9/1993 | Naka et al. | 451/307 X |
| 5,329,732 | 7/1994 | Karlsrud et al. . | |
| 5,333,413 | 8/1994 | Hashimoto . | |
| 5,361,545 | 11/1994 | Nakamura . | |
| 5,442,416 | 8/1995 | Takeyama et al. . | |
| 5,460,478 | 10/1995 | Akimoto et al. . | |
| 5,498,199 | 3/1996 | Karlsrud et al. . | |
| 5,514,025 | 5/1996 | Hasegawa et al. | 451/289 X |
| 5,547,515 | 8/1996 | Kudo et al. . | |
| 5,618,227 | 4/1997 | Tsutsumi et al. . | |
| 5,655,954 | 8/1997 | Oishi et al. | 451/287 |
| 5,679,055 | 10/1997 | Greene et al. . | |
| 5,700,046 | 12/1997 | Van Doren et al. . | |
| 5,762,391 | 6/1998 | Sumnitsch . | |
| 5,762,536 | 6/1998 | Pant et al. . | |
| 5,800,254 | 9/1998 | Motley et al. | 451/285 |

*Primary Examiner*—Timothy V. Eley
*Attorney, Agent, or Firm*—Skjerven,Morrill,MacPherson, Franklin and Friel; Edward C. Kwok; Roberta P. Saxon

[57] ABSTRACT

A wafer polisher head drive includes a head drive housing; a head portion extending from the housing for mounting an unpolished wafer when the head drive housing and head portion are in a horizontal orientation; a pivot mechanism extending from the head drive housing for pivoting the head drive housing and the head portion from the horizontal orientation to a vertical orientation juxtaposed to a transverse vertical portion of a continuous rotating polishing belt; a drive in the housing for moving the head portion and a mounted wafer outwardly from the housing against the transverse vertical portion of the rotating polishing belt; and a drive in the housing for rotating the head portion and the mounted wafer. The head drive housing may be pivoted from the vertical orientation in a sweeping arc extending perpendicularly from the belt transverse vertical portion or in a swinging arc extending parallel from the belt transverse vertical portion. The pivot mechanism includes a hollow shaft connected to said head drive housing; and a motor, gearbox and a ball screw and nut assembly in driving connection between the gearbox and the hollow shaft for transversing in a direction parallel to the belt.

10 Claims, 8 Drawing Sheets

WAFER POLISHING HEAD DRIVE

RELATED APPLICATIONS

This application relates to U.S. Ser. No. 08/964,930, filed Nov. 5, 1997 entitled Modular Wafer Polishing Apparatus and Method, H. Alexander Anderson et al.; U.S. Ser. No. 08/965,037, filed Nov. 5, 1997 entitled Wafer Shuttle System; U.S. Ser. No. 08/964,773, filed Nov. 5, 1997 entitled Polishing System Including a Hydrostatic Fluid Bearing Support, David E. Weldon et al.; U.S. Ser. No. 08/965,033, filed Nov. 5, 1997 entitled Wafer Carrier Head with Attack Angle Control for Chemical Mechanical Polishing, Gregory A. Appel et al.; Ser. No. 08/965,514 filed Nov. 5, 1997 for Linear Pad Conditioning Mechanism, Ethan C. Wilson et al.; Ser. No. 08/965,067, filed Nov. 5, 1997 for Apparatus for Dispensing Slurry, Peter Mok; and U.S. Ser. No. 08/964,774 filed Nov. 5, 1997 entitled Polishing Tool Having a Sealed Chamber for Support of Polishing Pad, Shou-Sung Chang et al., all assigned to applicants' assignee. The disclosures of each of the above related applications are incorporated herein by reference.

FIELD OF THE INVENTION

This invention relates to a head drive for a wafer polishing machine. More particularly, the invention relates to a head drive holding a semiconductor wafer for positioning the held-wafer against a belt-type polisher.

BACKGROUND OF THE INVENTION

Chemical mechanical polishing machines for semiconductor wafers are known in the prior art and are typified by U.S. Pat. No. 5,593,344 and the patent referenced therein. Generally these machines are customized for a customer's particular requirements and facility area. Further, most if not all of the prior art machines perform the polishing step(s) while the semiconductor wafer is in a horizontal position i.e. the wafer is positioned horizontally on a rotating horizontal table or horizontal belt section and a downward force is exerted on the wafer top side. This is done usually by a first platen or wafer carrier moving down with the wafer(s) to force the wafers against a second slurry-containing polishing platen or belt.

Chemical mechanical polishing (CMP) in semiconductor processing removes the highest points from the surface of a wafer to polish the surface. CMP operations are performed on partially processed wafers. A typical wafer is crystalline silicon or another semiconductor material that is formed into a nearly circular wafer. A typical processed or partially processed wafer when ready for polishing has a top layer of a dielectric material such as glass, silicon dioxide, or silicon nitride or a metallic layer over one or more patterned layers that create local topological features on the order of about 4000–10,000 Å in height on the wafer's surface. Polishing smoothes the local features so that ideally the surface of the wafer is flat or planarized over areas the size of a die to be formed from the wafer. Currently, polishing is sought that locally planarizes the wafer to a tolerance of about 1500–3000 Å over the area of a die.

A conventional belt polisher includes a belt carrying polishing pads, a wafer carrier head on which a wafer is mounted horizontally, and a support assembly that supports a horizontal portion of the belt under the wafer, as seen in FIG. 1 of the U.S. Pat. No. 5,593,344 patent. For CMP, the polishing pads are coated or sprayed with a slurry, and a drive system rotates the belt. The carrier head brings the wafer into contact with the polishing pads so that the rotating polishing pads slide against the surface of the wafer. Chemical action of the slurry and the mechanical action of the polishing pads against the surface of the wafer remove material from the surface. The '344 patent and U.S. Pat. No. 5,558,568 describe CMP systems using hydrostatic fluid bearings to support a belt. To polish a surface to the tolerance required in semiconductor processing, CMP systems generally attempt to apply a polishing pad to a wafer with a pressure that is uniform across the wafer. Methods and structures that provide uniform polishing are sought.

Further, since the prior art machines are increasingly being automated with robotic wafer loading and unloading systems, it has become desirable to reduce the complexity of the robotic system and to minimize the elapsed time for each unit operation and thus increase the efficiency of both the robotic system and the polishing machine. A need has also arisen to provide a more standard polishing machine at less cost which is adapted to virtually any production rate need and to fit into a broad range of facility spaces.

SUMMARY OF THE INVENTION

The present invention relates to a wafer polishing (or buffing) machine of the modular type where several duplicate machines can be employed in end-to-end configurations or side-by-side configurations or both end-to-end and side-by-side configurations integrated with an appropriate, relatively simple robotic system servicing one or more of the machines. While the word "duplicate" is used, it is understood that there may be some variances from one machine to another in that for example a polish step may include a different polish path than in a buffing step. Essentially each module is pretty much 99+% identical with another. The number and location of the modules can be tailored to the customer's production needs and facility spaces.

In a preferred embodiment the wafer is in a horizontal orientation while being handled for loading and unloading and in a vertical orientation when polishing (or buffing) is being done. Thus the robot or its wafer-holding end effector need not turn the wafer vertically which dispenses with a wafer turning movement in the robot system, thus simplifying the robot system. Instead a wafer-mounting and holding head drive mechanism, shuttle mechanism and staging/rinsing mechanism is employed which receives and allows removal of wafers in a horizontal orientation and where the head drive mechanism is turned 90° into a vertical orientation along with the mounted wafer for the polishing or buffing operations. Each module is encompassed by a frame, is compact and can accommodate and mount two or four or more polishing or buffing heads and assemblies.

A vertical polishing machine thus is provided which transfers a wafer or wafers from a wafer cassette by a linearly movable robot, to a staging/rinsing mechanism. The shuttle mechanism, particularly equipped with a wafer-edge gripper will move in to either load the to-be-polished wafer or unload a polished wafer. The shuttle mechanism then moves between the staging/rinsing mechanism and the head drive which has a distal end in a horizontal orientation. A horizontal wafer is loaded and held on such distal end, normally by vacuum attachment. The head drive is then pivoted (tilted) and oriented 90° to also tilt a held-wafer to a vertical orientation and the head (and wafer) then are moved linearly and horizontally to press against a polishing pad of a vertical transverse section or portion of a continuous moving belt, and with use of an appropriate fine abrasive slurry, to polish or buff the wafer surface. The polishing and buffing operations are similar except for using deionized water or other fluid without abrasives, the choice of polishing pad material and nap and the speed and pressure of the belt and head drive, respectively.

In one embodiment the gripper allows for a simple transfer of wafers delivered by the robot, with wafer-contact only on the peripheral outer edge of the wafer. Since the gripper does not touch the front or back surfaces of the wafer there can be no particulate contamination of these surfaces nor any indentations or scratches made on the surfaces. Also included is a rinse box which is used to rinse slurry from the polished surface and to maintain the wafer in a wet environment to prevent dry-out which otherwise can cause wafer defects. If buffing is to be done, the robot can then pick-up a polished and wetted wafer and convey the wafer to another horizontally oriented head drive adjacent to a rotating buffing belt having a vertically-oriented transverse portion with buffing pads.

The gripper incorporates a series of horizontal sectors which are movable radially. Each sector includes one or more fixed depending fingers which moves radially inwardly with a sector so that the finger(s) abut and presses against the wafer edge with a holding force. The gripper is part of the shuttle mechanism and when the shuttle is moved linearly inwardly the gripper with the edge-attached wafer is positioned over the horizontal head mechanism where it can be released and placed on the distal end of the head drive and vacuum-held thereon. During the polishing step the wafer and the wafer-mounting portion of the head may be rotated and also swept side-to-side in a vertical plane so as to average out any imperfections in the polishing pad. The speed of the belt and the pressure executed on the belt by the head and wafer is controlled by a computer input. The wafer-mounting portion of the head is slideable in and out of the overall head to control the polishing pressure. A motor in the head drive provides the torque to rotate the wafer mounting portion of the head. The vertical orientation and linearity of the machine operation permits a user to provide higher relative linear velocity between the wafer and the polishing pad. The head pressure may be less, thus achieving the same removal rate of material with greater efficiency in planarization.

The present invention permits the polishing or buffing of two wafers at the same time since two heads may be employed facing each other and being movable against opposite vertical sides of the continuous belt. The two wafers are then pressed against the belt at opposite outwardly-facing rotating transverse portions of the belt containing the polishing or buffing pads.

The wafer polishing apparatus includes a module frame; a continuous belt rotatable with respect to the frame, the belt having at least one vertically-oriented belt transverse portion including a polishing pad assembly; and at least one pivotable wafer-holding head drive within the frame and having a distal end movable to a vertical first position parallel and juxtaposed to the belt transverse portion. The head drive includes a wafer carrier for holding a wafer on the distal end of the head drive, while a drive moves the head drive and a held wafer into a vertical polishing position abutting the belt transverse portion and pressure is applied to the held-wafer against the polishing pad assembly. After polishing the drive is reversed and the head drive is pivoted away from the belt transverse portion and the then-polished wafer removed.

DETAILED DESCRIPTION

Figure 1:
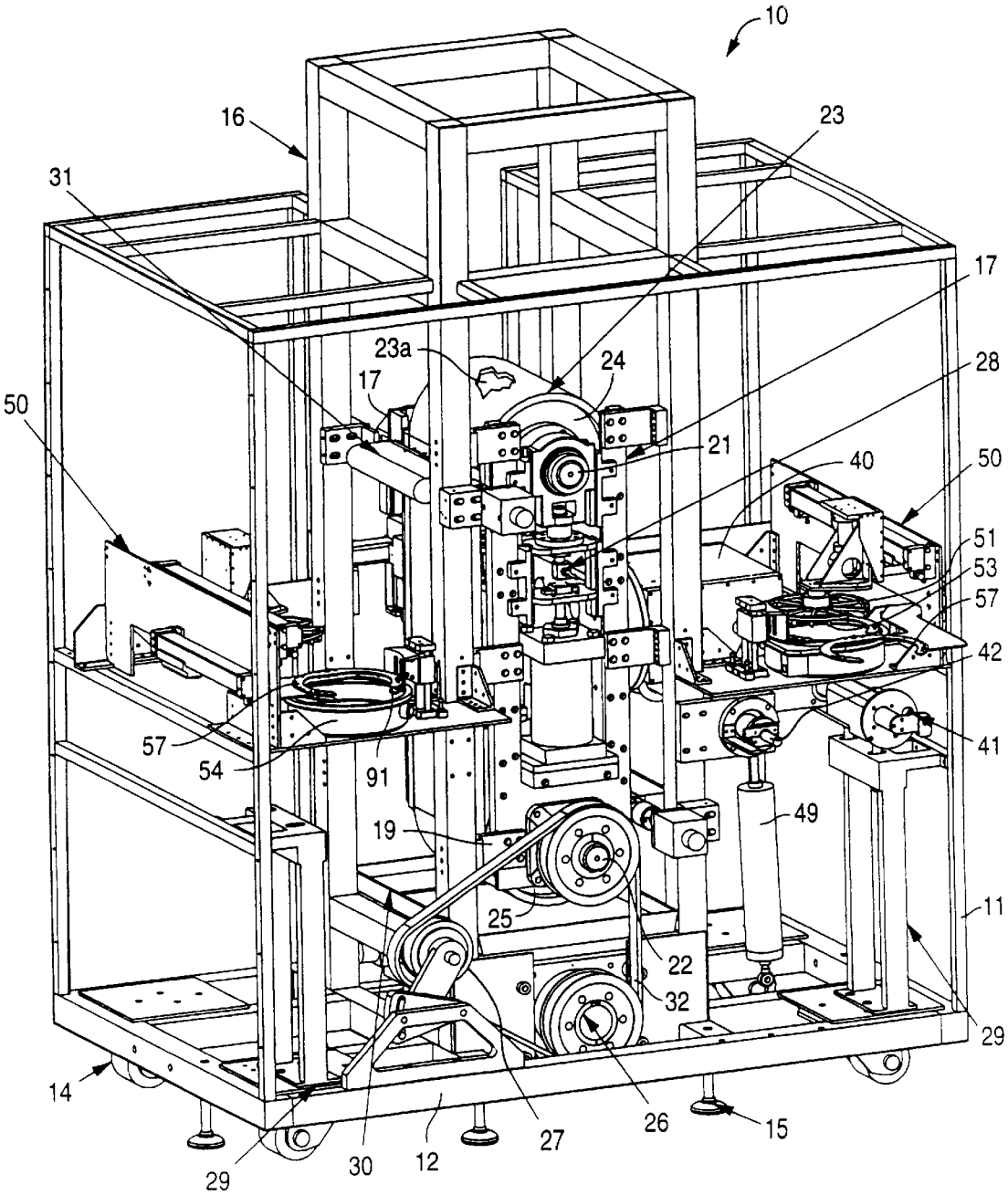
FIG. 1 is a side perspective view of the modular wafer polishing module.
Figure 2:
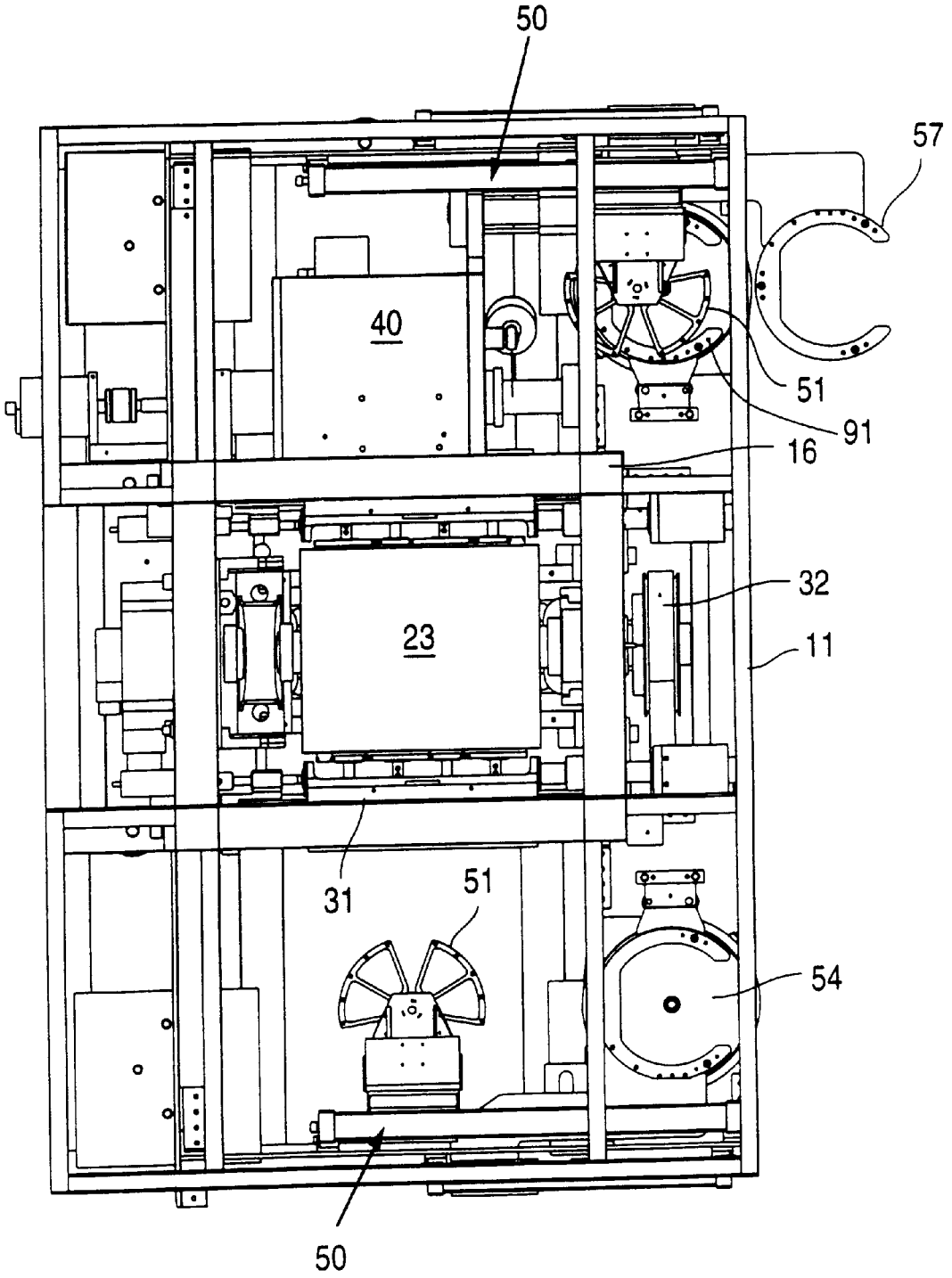
FIG. 2 is a top view thereof.

FIGS. 1 and 2 illustrate a single module of the wafer polishing apparatus 10 in which various components are mounted within a structural frame 11. Frame 11 has a bottom base 12 including wheel casters 14 and leveling feet 15 for moving the module and horizontally positioning the frame, respectively. An internal polisher frame 16 mounts a pair of pulley supports 17 which support a freely—rotating top pulley shaft 21 and a mounting 19 supports bottom drive shaft 22 which drives a polishing belt 23 continuously mounted on revolving drums 24 and 25. Drive shaft 22, the drums and the belt 23 are belt driven by a motor 26 driving a timing belt 32. The timing belt 32 is tensioned by a belt drive tensioner 27. A polishing belt tensioner 28, comprising an air cylinder or a motor, is utilized to tension the polishing belt. While polishing wafers, another mechanism 31 called a conditioner, with different abrasive material and various pressure and various oscillation speed either in-situ or ex-situ conditions the polish pad to optimize the polishing result. The conditioner 31 and other polisher structures are seen in Related application Ser. No. 08/965,514.

Figure 5:
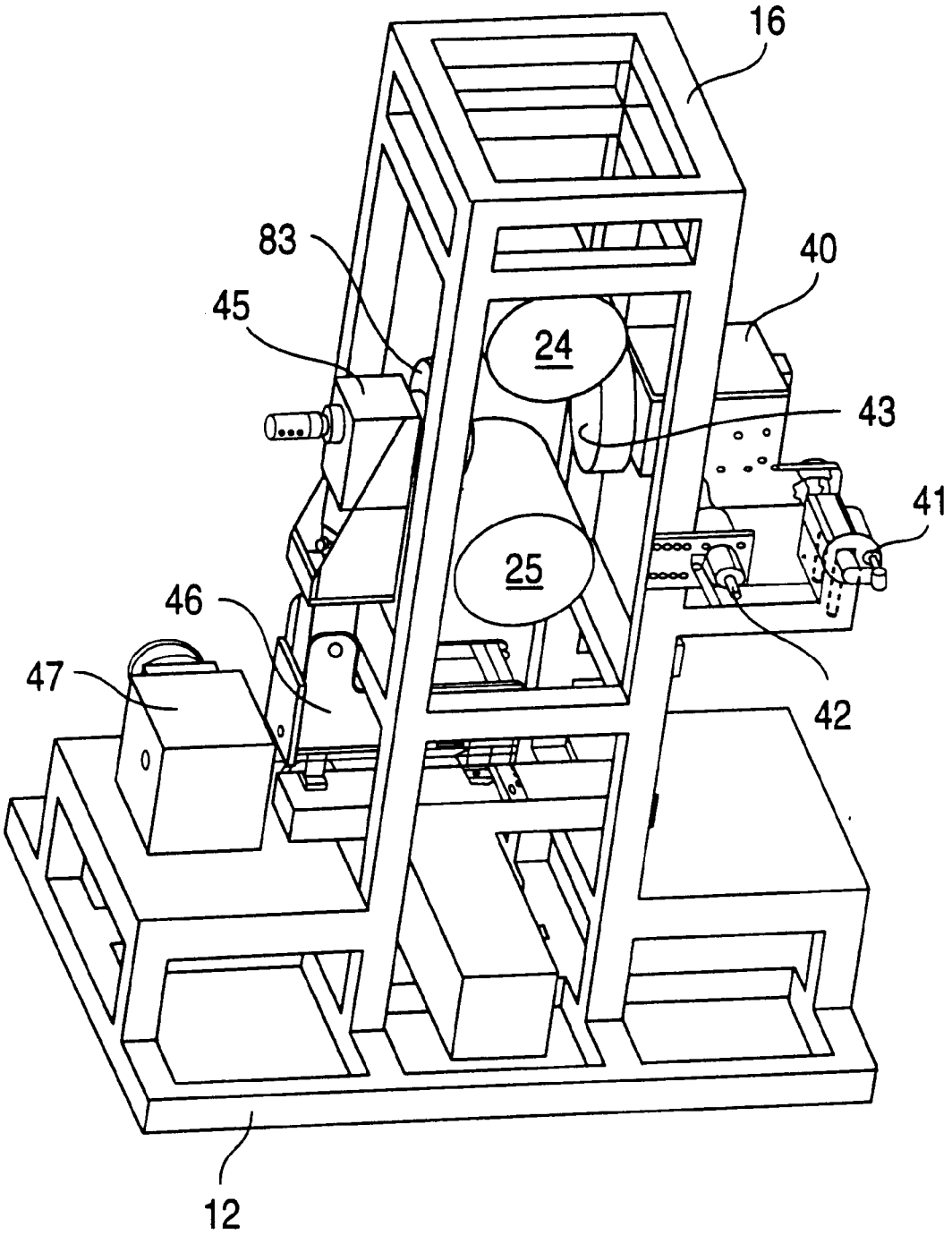
FIG. 5 is a perspective view of the two types of head drives in a polishing position.
Figure 6:
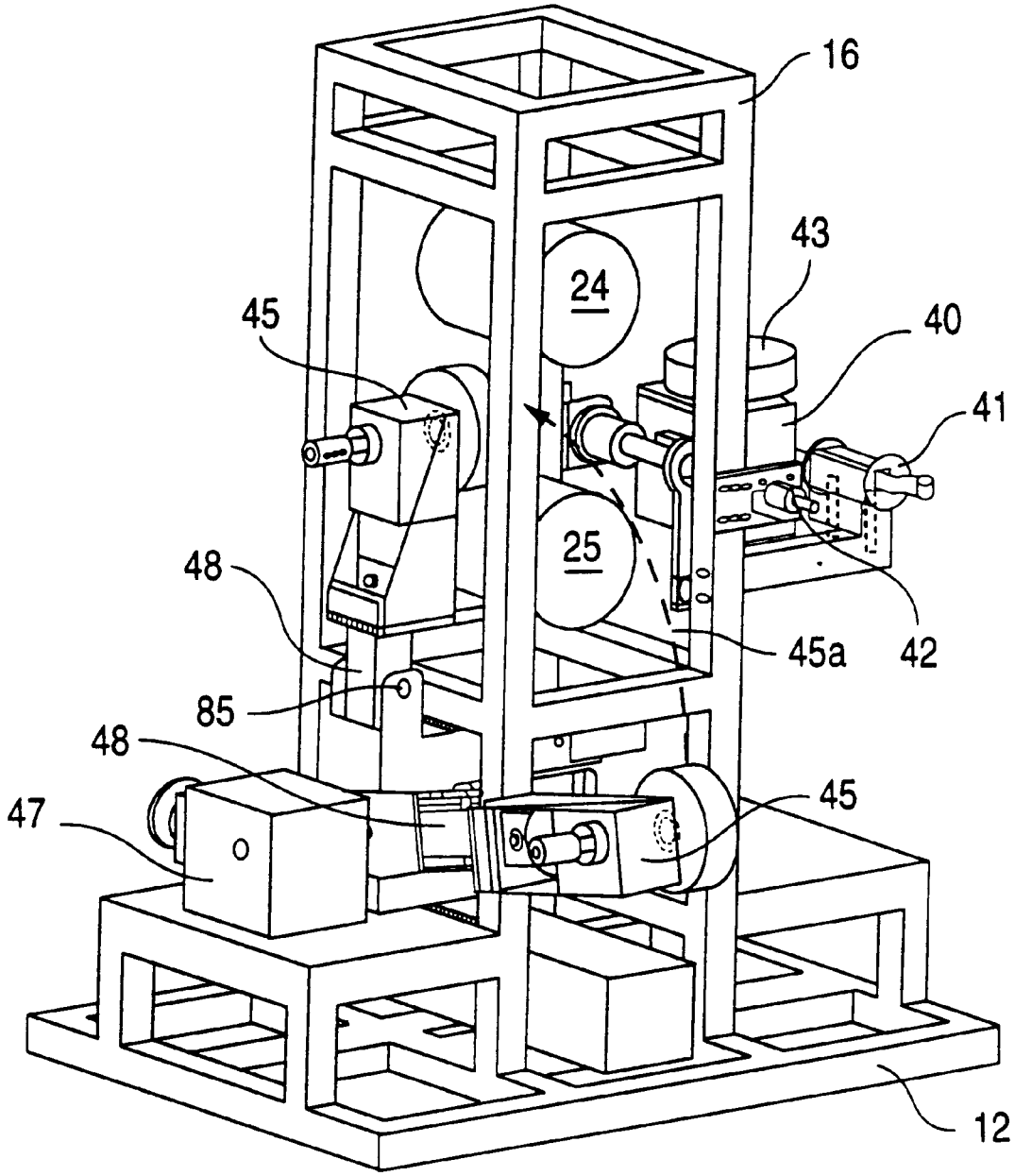
FIG. 6 is a perspective view of a sweep head drive in wafer transfer position and a swing head drive in alternative wafer polishing and wafer transfer positions.
Figure 7:
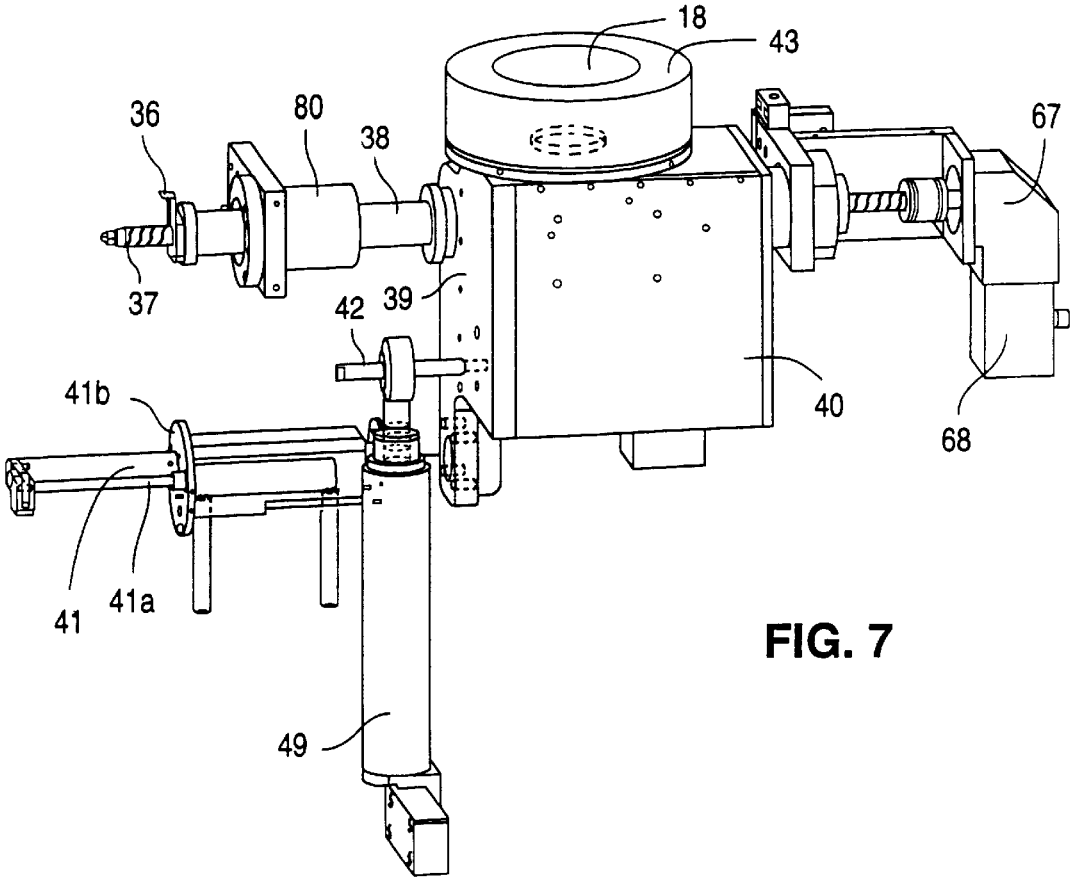
FIG. 7 is a rear perspective view of the sweep type head drive in the wafer transfer portion.

Subframes 29 are provided to support a locking mechanism 41 (one shown) for a polishing head drive 40 (FIGS. 5–9). A stub shaft 42 is also connected to frame 16 and is linked to a pneumatic cylinder 49 or other linear device such as a ball screw to pivot head drive 40 from a vertical position shown in FIGS. 1, 5, and 8 to a horizontal position to be loaded with a wafer to be polished (FIGS. 6–7). A drip pan 30 extends under the polishing drums and polishing belt and under the staging and rinse mechanisms (not shown) to catch abrasive slurry waste from the apparatus. A slurry dispenser as described in the Related application Ser. No. 08/965,514 may be employed to dispense slurry to the belt and wafer interface. While only one drive head is shown in FIG. 1, duplicative or other drive heads (FIG. 6) may be employed to be juxtaposed vertically to opposite vertical sides of the drums and polisher belt assembly.

A pair of shuttle stations 50, a right-hand one and left-hand one, are connected to frame 11. One of these is seen in detail in FIG. 4. The stations each provide a wafer transfer shuttle to move wafers horizontally and vertically into and out of a position in a wafer-receiving portion of the head drive when the head drive portion is in the horizontally oriented position. The shuttles also cooperate with a robot so that unpolished wafers can be conveyed from a wafer cassette (FIG. 10) to a robot-to-shuttle transfer assembly also called the staging/rinsing mechanism. After polishing, the wafers are returned by the shuttle to a rinsing bath to wash off the slurry from the wafer where they are picked up by the robot and conveyed to a buffing station or direct to a polished/buffed wafer cassette or to a downstream processing station.

Figure 11:
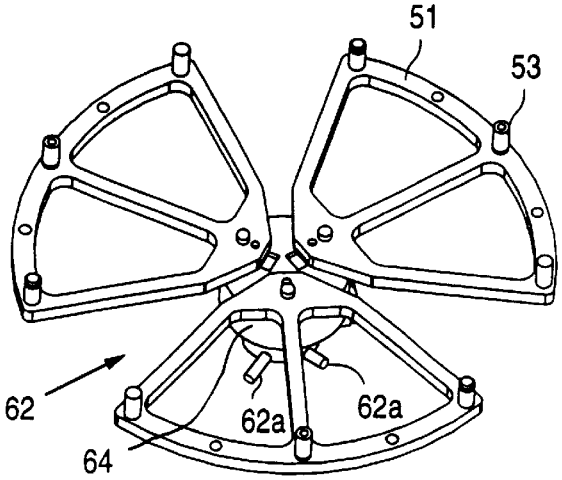
FIG. 11 is a perspective upside down view of the gripper segments and fingers.

The wafer edge-gripper includes fingers 53 depending from a number of radially-moving station segments 51 driven in and out by a pneumatic gripper which fingers grip the peripheral outer edges of the wafer when the segments and attached fingers are incrementally moved inwardly to abut the wafer edges. The segments 51 are typically three in number and extend over an arc of about 80°. The fingers are preferably made of a corrosion-resistant plastic material and extend about 10 mm from the underside of the segments (FIG. 11). The segments are actuated by pressurized air in a chamber 64.

A wafer rinse bath 54 is provided juxtaposed to the shuttle so that the wafer, after being polished, can be washed to remove abrasive slurry, prior to transfer by the robot to a buffing station or other processing station if buffing is not to be done or to polished wafer cassette. The wafer transfer assembly 60 with fingers 53 abut and grasp the polished wafer edges at spaced locations and moves to a position over the staging/rinsing mechanism. Air cylinder 61 is actuated to lower the wafer onto unloading ring 91 by moving segments 51 radially outward by actuation of the pneumatic gripper 62. Then the unloading ring 91 and wafer resting thereon are moved downwardly by a vertical drive 56 (FIG. 4) to dip and rinse the wafers in and out of the bath one or more times. A water spray 55 (FIG. 4) may be utilized to flush abrasives off of the wafer. The spray enhances cleaning of the polished or buffed surface. Contact of the wafer only at the peripheral edges greatly reduce contamination. Further bath storage of the wafer in both deionized water or other fluid prevents slurry drying before the robot is ready to pick up the wafer. The wafer can be held in the bath for spray cleaning, can be mechanically scrubbed, can be subjected to mega or ultrasonic cleaning or can be rotated the bath.

Figure 4:
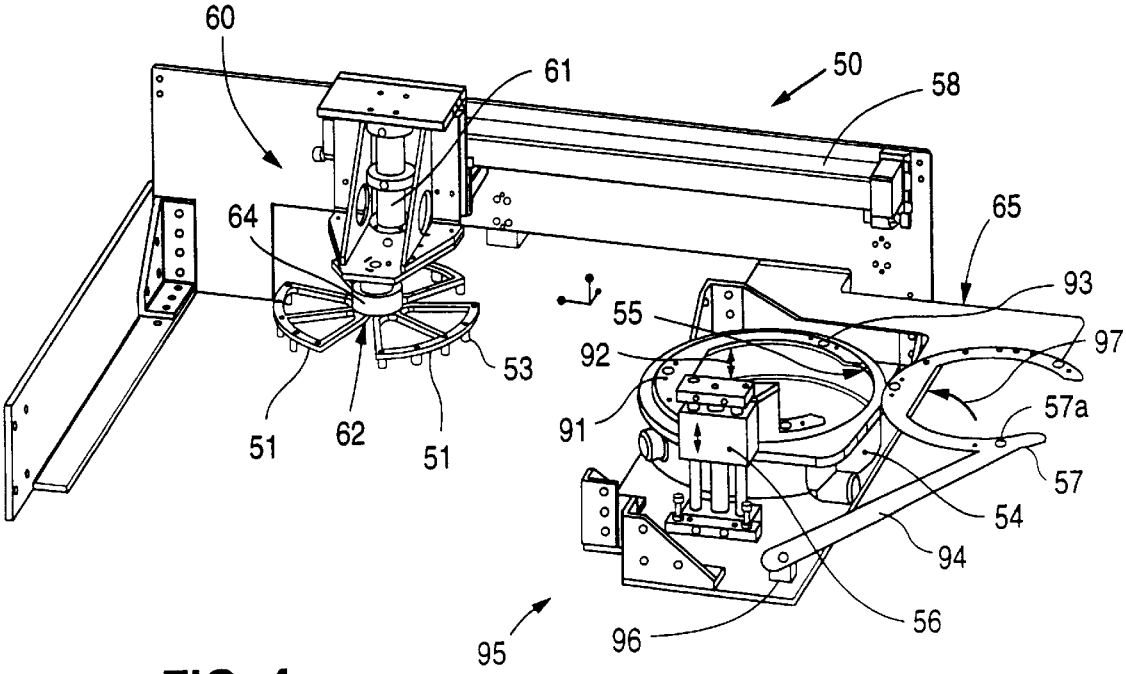
FIG. 4 is a perspective view of a shuttle and an associated edge gripper and wafer staging/rinsing mechanism.

FIG. 4 illustrates the operation of the shuttle station 50 where a rail 58 mounted to frame 11 mounts a linearly-moving edge grip wafer transfer assembly 60 including the aforementioned segments 51 with depending fingers 53. An air cylinder 61 is actuated to raise or lower the pneumatic gripper 62. The gripper 62 is connected to a wafer transfer assembly 60 and moves the segments 51 radially by pneumatic force provided in chamber 64 into wafer gripping or wafer non-gripping positions. The unpolished wafer is first received from the robots 70 more particularly robot 8 (FIG. 10) onto a receiver 57 in the form of an open-end loading ring which allows the robot end effector to load and unload a wafer. The receiver 57 (loading ring) and the unloading ring 91 includes a series of plastic nubs 57*a* and 93, respectively, to raise the wafer from the respective ring surfaces and to facilitate the gripping of the wafer edges by the gripper. The rings at this time are positioned over the bath. The ring 57 may be moved outwardly as seen in FIG. 4 to allow a polished wafer to be placed on ring 91. This movement is provided by a pivot arm 94 fixed to loading ring 57 and both being pivoted (arrow 97) by a motor 96 so that ring 57 extends over unloading ring 91. The shuttle assembly is moved to a position over the moved receiver (loading ring) 57 and by actuation of air cylinder 61 moves the segments over the wafer with the depending fingers spaced from the wafer peripheral edges. The segments 51 are then moved radially inwardly by actuation of the pneumatic gripper 62 (FIG. 11) operable by pressurized air through inlet 62*a*, so that fingers 53 abut and grasp the wafer edges at spaced locations. A three-jaw grabber Model MHR 3C-15R from SMC of Japan may be used to radially move the segments. The assembly 60 including the segments and wafer, the latter always in a horizontal orientation, is then transferred inwardly along rail 58 to a position (to the left in FIG. 4) over the head drive which has been pivoted to a horizontal orientation as seen in FIG. 6. The gripper 61 vertically transfers the segments and gripped wafer onto the head portion 43 of the head drive 40, where the wafer is preferably then vacuum-held on the head portion 43. The segments are radially actuated outwardly to release the gripping action of fingers 53, the segments are raised and the assembly 60 moved along the rail outwardly (to the right in FIG. 4) to allow the repivoting of the drive head to a vertical orientation juxtaposed to the polishing belt. The shuttle action is repeated in reverse to remove a polished wafer from the head drive after the head drive has been pivoted 90° back to its horizontal orientation. The polished wafer, grip-attached to the segments 51 and containing abrasive slurry on the wafer, is then moved along the rail 58 to a position over bath 54 for cleaning/spraying the wafer as explained above. The polished and cleaned wafer is then moved upward and can be picked up by the robot 70 and conveyed to a buffing station 90 (FIG. 10), another processing station or to a polished wafer cassette. The buffing station may be a duplicate of the polishing apparatus save for the polishing pad material and the buffing speed and pressure exerted by the motor driven head 43. The assembly 60 is driven along rail 58 by a conventional air cylinder and piston (not shown) in the rail and where the piston rod distal end is connected to assembly 60, or by a lead-screw or other standard mechanism.

Figure 3A:
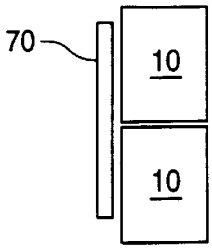
FIG. 3A is a block diagram showing one configuration of modules.
Figure 3B:
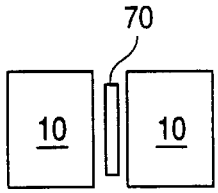
FIG. 3B is a block diagram of a second configuration of modules.
Figure 3C:
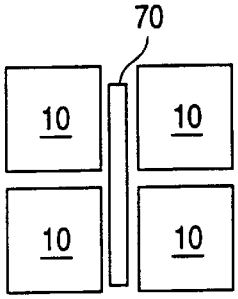
FIG. 3C is a block diagram of a third configuration of modules.
Figure 3D:
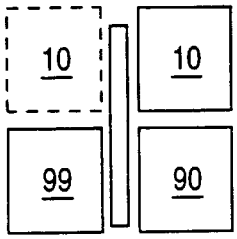
FIG. 3D is a block diagram of a fourth configuration of modules.

The modules 10 may be arranged in various configurations. FIG. 3A shows modules 10 end-to-end with a robot 70 alongside. FIG. 3B shows modules 10 side-by-side with a robot 70 therebetween. FIG. 3C shows modules 10 both end-to-end and side-by-side with a robot 70 between each pair of side-by-side modules. FIG. 3D shows three modules 10,90 and a module 99 for outer supporting process stations such as cleaners or metrology tools. This FIG. 3D configuration is seen in schematic detail in FIG. 10 where a robot can position wafers to either one of the polishing modules 10, and then to a buffing module 90. While polishing is being done the robot 70 can position another wafer to a buffing module 90 in another polishing module 10. The robot may be a robotic system such as Model RR 701 L 0314 available from Rorze Co. of Japan.

Figure 8:
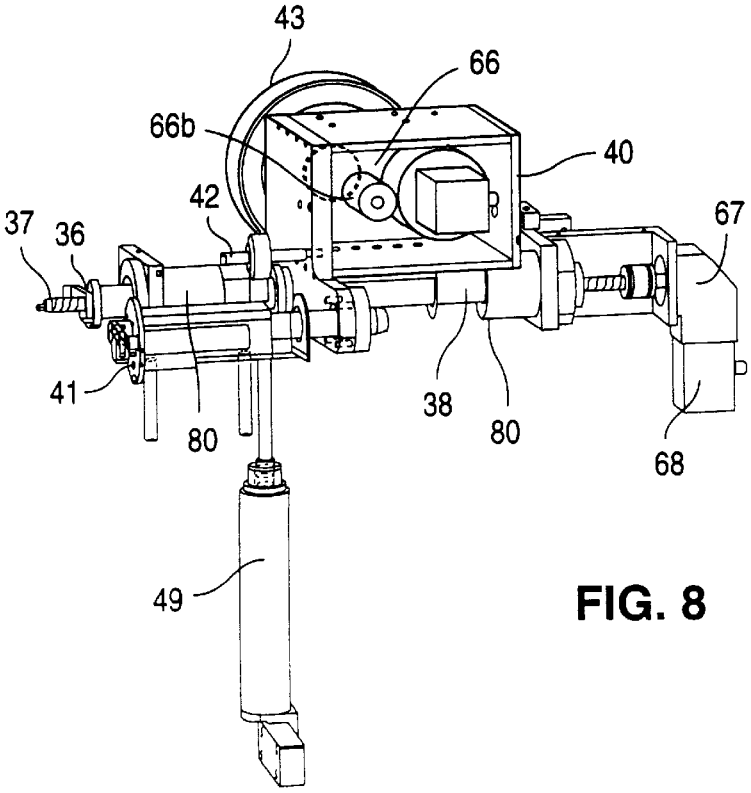
FIG. 8 is a rear perspective view thereof in the polishing position.

FIG. 5 shows two embodiments of the head drive. Head drive 40 (called herein a "sweep" drive) is shown positioned in a vertical orientation of the head portion 43. The polishing belt has been removed for purposes of clarity. The head drive is pivotable to a horizontal position of head portion 43 for horizontal unloading or loading of a wafer. As shown in FIGS. 7 and 8 the sweeping motion is provided by a motor 68 and gearbox 67 through a ball screw 37 and nut 36 assembly driving a hollow shaft 38 attached to the head drive housing 39. In a polishing position a pin lock 41 holds the head drive in the position shown in FIG. 5. An electrical motor 66 (FIG. 8) drives rotatable head portion 43 with computer controllable rotating speed and pneumatic pressure is provided through a rotary union 66*b* which forces the wafer in the head portion 43 to contact the polishing pads 23*a* (schematically shown in FIG. 1) on the belt 23. Bearings 80 support the hollow shaft 38. On an opposite side of the belt drums 24,25 a second polishing system is provided so that two wafers can be simultaneously polished by the same belt and polishing pads. Also it may be provided that two or more polishing systems are juxtaposed to each of the sides of the belt.

The second system may be a "swing" drive including a swing drive head 45 having a rotatable wafer-holding head portion 83 (FIG. 9) and air cylinder 84 (FIG. 9) to rotate the swing head 45 and head portion 83 around the pivot point 85, and a mounted wafer in head portion 83 against the polishing pads. The details of the movement of the head and held-wafer are seen in the related application Ser. No. 08/965,033 where a inflatable bladder 18 in contact with the rear of the wafer moves the held-wafer into pressure contact with the polishing pads of the belt.

Rear support of the belt, i.e. behind the area upon which the held-wafer is pressed against the belt, is seen in the related application Ser. No. 08/964,773 where a hydrostatic bearing is used or in the related application Ser. No. 08/964,774 where a sealed fluid pocket is used. The drive head 45, while polishing the wafer, is sweepable by a gear box and motor 47 with respect to the polishing pad. After wafer polishing, the swing drive 45 is then pivoted outwardly about pivot 85, and then swung by the gear box and motor 47 from the vertical position shown in FIG. 5 typically 90° along the curved dashed line 45*a* to a position shown in FIG. 6 for loading of a polished wafer and loading of another wafer for polishing. The swing drive 45 is then pivoted outwardly about pivot 85 to place head portion 83 and drive head 45 in a vertical orientation. In this case the wafer is loaded and unloaded vertically. If desired an additional mechanism (not shown) can be incorporated to place the wafer into a horizontal position for unloading of a polished wafer and loading of another wafer for polishing.

FIGS. 7 and 8 show the two positions of sweep head drive 40, the former in a horizontal orientation for wafer loading or unloading and the latter in a vertical position for polishing. In FIG. 7 a locking pin 41*a* which is retractable in and out of an aperture(s) in a fixed apertured plate 41*b* locks head drive in a polishing vertical orientation. A locking mechanism contains a locking pin and pneumatic or electrical operated engaging force mechanism. This locking mechanism provides the stability and rigidity to the head drive while the wafer is being polished. A stub shaft 42 connected to the housing 39 provides a connection for the distal end of the pneumatic cylinder 49. The pneumatic cylinder 49 piston movement which provides the pivot force for the head drive 40 is seen extended in FIG. 8 for the polishing operation and retracted in the unloading/loading operation in FIG. 7.

Figure 9:
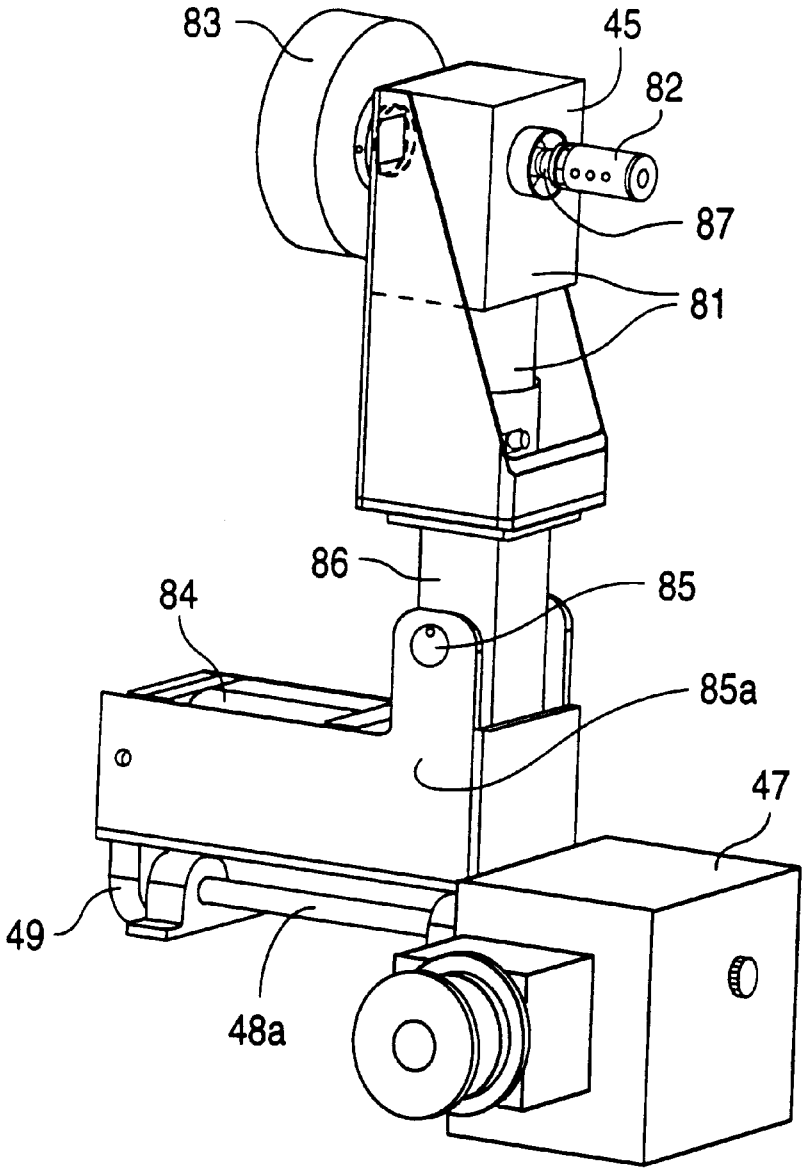
FIG. 9 is a side perspective view of the swing head drive assembly.

A detailed view of the swing head drive is seen in FIG. 9 after the actuation of pneumatic cylinder 84 to tilt arm 86 about pivot 85 to pivot and swing head drive 45 and head portion 83 to a vertical orientation for wafer polishing. Pneumatic cylinder 84 tilts arm 86 about pivot pin 85 to a tilt out position of the rotating mechanism 84, 86, 81, 45 and 83 for servicing and wafer loading or unloading. Motor and gear box 81 provide the rotation motion of head 83. The shaft and rotary union 82 provide air and other media to head 83. The gear box and housing 47 includes a drive shaft 48*a* and a clevis 49 attached to the underside of housing 85*a*.

Figure 10:
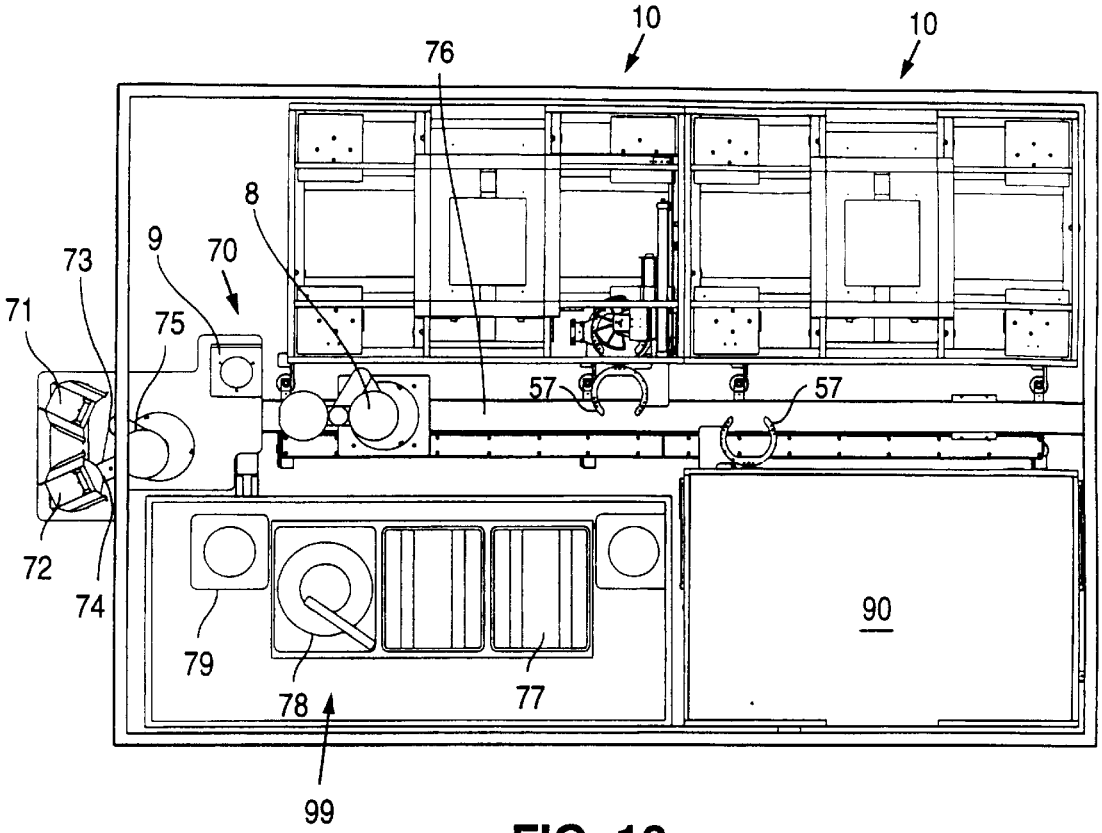
FIG. 10 is a top schematic view of a module system layout including the wafer processing robot.

The robot 70 is schematically shown in FIG. 10. An unpolished wafer cassette 71 and a polished wafer-receiving cassette 72 are provided normally outside a side covered frame and are accessed through an inlet/outlet port 73 in the side cover by a robot end effector 74 on a rotable stationary robot head and arm 75 to a transfer station 9. A second robot head and arm 8 after picking up a wafer(s) at station 9 is movable linearly along track 76 to a position to mount a wafer on loading ring 57 which is rotated into polishing module 10 and above the ring 91 (FIG. 4) where the shuttle system 50 takes over. The robot head and arm can then proceed to unload a polished or buffed wafer from buffing module 90 or to pick up and deliver another wafer to module 10 or area 99. A module 99 area may contain one or more brush cleaners 77, a spin rinse drier 78 and an unload station 79 which function, respectively to clean wafers of slurry deposits.

In an exemplary embodiment the mounted wafer and head portion is rotated at a speed of from 1 to 100 revolutions per minute. A preferred range is 20–60 rpm. Generally for a 8" wafer, the wafer and head portion is pressed against the polishing pads with a force of about 1–10 psi. In this example the belt is rotated at a linear speed of the belt surface in the range of from 50 to 600 ft./minute. For typical polishing a water slurry is utilized typically with abrasive particles of silicon dioxide having particle sizes of from 30 manometers to 500 manometers.

The above description of embodiments of this invention is intended to be illustrative and not limiting. Other embodiments of this invention will be obvious to those skilled in the art in view of the above disclosure.

We claim:

1. A wafer polisher head drive for pressing a wafer against a continuous rotating polishing belt comprising:

a head drive housing;

a head portion extending from the housing for mounting an unpolished wafer when the head drive housing and head portion are in a horizontal orientation;

a pivot mechanism extending from the head drive housing for pivoting the head drive housing and head portion from the horizontal orientation to a vertical orientation juxtaposed to a transverse vertical portion of said polishing belt, wherein said polishing belt is in a vertical position; and a drive in the housing for rotating the head portion and the mounted wafer while pressing the mounted wafer against the transverse vertical portion of the polishing belt.

2. The head drive of claim 1 wherein said head drive housing is pivoted from the vertical orientation in a sweeping arc extending in a plane perpendicular to the plane of the head drive housing in said vertical orientation.

3. The head drive of claim 2 wherein said pivot mechanism includes a hollow shaft connected to said head drive housing; a gearbox connected to said head drive housing; and a ball screw and nut assembly positioned in driving connection between said gearbox and said hollow shaft for sweeping said head drive housing back and forth in a in a plane parallel to the plane of the head drive housing in said vertical orientation.

4. The head drive of claim 3 further comprising a lock pin insertable into an apertured plate attached to said head drive housing for stabilizing said head drive housing in the vertical orientation during polishing of the mounted wafer.

5. The head drive of claim 1 further including a pneumatic cylinder having a piston rod having an outer distal end linked to said head drive housing to actuate the head drive housing between the vertical orientation and the horizontal orientation.

6. The head drive of claim 1 wherein said head drive housing is pivoted from the vertical orientation in a swing arc extending in the plane of the head drive housing in said vertical orientation.

7. The head drive of claim 6 including a motor and gearbox, said motor and gearbox driving said pivot mechanism for laterally pivoting said head drive housing; and further including a tiltable arm extending between said gearbox and said head drive housing, said tiltable arm, when pivoted from a vertical orientation, being tiltable to place the head portion in an orientation for unloading of a polished wafer and subsequent loading of an unpolished wafer.

8. The head drive of claim 7 further including a gearbox housing;

a drive shaft extending from the gearbox housing;

a clevis connected to the drive shaft and pivotable with the drive shaft and having a pivot pin connecting said tiltable arm to said head drive housing; and a pneumatic cylinder having a piston distal end connected to said tiltable arm for tilting the tiltable arm about said pivot pin to move said head portion to the unloading orientation.

9. The head drive of claim 1 further including a rotary union extending between said head drive housing and said head portion.

10. The head drive of claim 1 wherein said pivot mechanism includes a hollow shaft and a drive in-line with said shaft for sweeping said head drive housing and a mounted wafer back and forth in the plane of the head drive housing when in a vertical orientation.

* * * * *